United States Patent [19]

Dussoliet et al.

[11] Patent Number: 4,519,554

[45] Date of Patent: May 28, 1985

[54] DEVICE FOR DRIVING A PROTECTION AWNING

[75] Inventors: Jacques Dussoliet, Cluses; Michel Dieupart, Sallanches, both of France

[73] Assignee: Somfy, France

[21] Appl. No.: 600,128

[22] Filed: Apr. 13, 1984

[30] Foreign Application Priority Data

May 19, 1983 [FR] France ..... 83 08285

[51] Int. Cl.[3] ..... B65H 17/02

[52] U.S. Cl. ..... 242/67.4; 242/75.44

[58] Field of Search ..... 242/67.4, 73.5, 67.2, 242/203, 204, 67.1 R, 67.1 D; 4/502; 310/41; 160/265, 310; 192/45, 2, 127; 188/82, 84

[56] References Cited

U.S. PATENT DOCUMENTS

| | | | |
|---|---|---|---|
| 2,325,885 | 8/1943 | Serrurier | 242/206 |
| 2,603,678 | 7/1952 | Helmer | 310/93 X |
| 2,993,660 | 7/1961 | Parks | 242/84.51 R |
| 3,806,061 | 4/1974 | Kollar et al. | 242/186 |
| 3,975,652 | 8/1976 | Hammond | 310/41 |
| 4,225,098 | 9/1980 | Henkler et al. | 242/204 X |
| 4,444,363 | 4/1984 | Jacquel et al. | 242/67.4 |

*Primary Examiner*—Stephen Marcus

*Assistant Examiner*—Leo J. Peters

*Attorney, Agent, or Firm*—Darby & Darby

[57] ABSTRACT

This invention relates to a device for driving a horizontal sheltering awning having one end adapted to be rolled on a first winding shaft and another end adapted to be connected through flexible straps to another winding shaft on which these straps can be rolled up. Each winding shaft is adapted to be driven by a separate motor. A fixed portion of each motor case encloses a retarder cooperating with a unidirectional driving device of which the two sections are disposed on a rotary movable element and on the output shaft of the corresponding motor, on which the rotary movable element is pivoted, respectively. The two sections of the eddy-current type retarder are disposed the one on the outer periphery of the rotary movable element and the other inside the fixed case, respectively. The first section consists of a copper socket and the other of permanent magnets. Each unidirectional driving device is so oriented as to provide the angular coupling between its two sections only when the corresponding windings shaft is rotatably driven not by its motor but by the motor of the other winding shaft via the awning and the flexible straps. The eddy-current type retarder of this driven winding shaft is then operative.

5 Claims, 4 Drawing Figures

DEVICE FOR DRIVING A PROTECTION AWNING

BACKGROUND OF THE INVENTION

The present invention relates to devices for driving an awning for protecting an area against sunshine, rain, this awning being adapted to be at least partially spread out horizontally. One end of the awning is attached to a winding shaft and the other, free end of the awning is connected via one or several flexible straps to another winding shaft. Each winding shaft is coupled angularly to a rotary driving member or unit, consisting for example of an electric motor and reduction gear unit or of a manually operated mechanical device. One of these driving means is adapted to rotate in a direction permitting of winding up the awning on its winding shaft while unrolling the flexible strap or straps from the other winding shaft. The other rotary driving member is adapted to drive the relevant shaft in the direction permitting of winding the flexible strap or straps on the winding shaft while unrolling the awning from its shaft.

THE PRIOR ART

In known driving device of this general type, such as disclosed for example in the French Pat. No. 2,502,597, the primary object is to stretch the awning properly when the awning is spread out to its operative or sheltering position, but no provisions are made for maintaining this tension during the winding and unwinding operations, which may prove rather detrimental in most cases. In the above-mentioned French Patent the two rotary driving means consist of electric motor and reduction gear units and when one of the motor and reduction gear units is operating and winds up the flexible straps on the corresponding winding shaft, for unrolling the awning from the other winding shaft, the awning tension is obtaining only through the resistant torque exerted by the motor and reduction gear of this other winding shaft which, during this operation, is not energized. This resistant torque is due to the various frictional contacts produced in the motor, reduction gear, winding shaft bearings, etc. Under these conditions, the awning is not sufficiently taut during the unrolling thereof, since this unrolling does not take place regularly. In fact, initially this other winding shaft and more particularly its motor and reduction gear unit, which is driven, are standing still and subjected to a certain inertia when the other or driving motor and reduction gear unit is started, so that the awning is properly tensioned. But immediately, thereafter, the driven motor and reduction gear unit is rotatably driven in turn by the awning tension and tends to rotate faster than required for freeing the awning, and the awning is slightly eased off. Thus, the driven motor and reduction gear unit is stopped again during a short time, and the awning is thus tensioned against, and so forth. Therefore, at the beginning of the unrolling operation the awning tension increases and decreases alternatively at an accelerated rate and the awning sag remains relatively moderate, for example one or two inches. However, when the awning is unrolled on a distance of several meters for, as this unrolling proceeds, the mass of the unrolled awning increases and its influence is felt more and more widely but at a decreasing rate. When the awning is unrolled to the extent of 4 to 5 meters, each time the driven motor and reduction gear unit is stopped, the awning is really very slack, with a sag of about one meter to one meter and a half. The motion is further amplified by the mass of a transverse bar disposed as a rule along the free or leading end of the awning for imparting a transverse rigidity thereto. Theoretically, a solution to this problem would consist in providing under the awning at spaced intervals a plurality of transverse supporting rods, but this solution is obviously unsightly and more complicated and consequently expensive. By windy weather the above-described described phenomenon is strongly amplified, for example two or three times, and the awning tends to bulge upwards under the wind pressure. The same inconvenience also appears of course whether the awning is rolled or unrolled.

The same effect is observed when the awning is intended for sheltering the substantially horizontal roof and the substantially vertical front of a verandah, in which case one portion of the awning is horizontal and the other portion is vertical. When the awning is unrolled sufficiently to enable its free end to reach approximately the middle of its vertical portion and thus approach its completely unrolled condition, the weight of the awning and of the transverse rod provided at its free end tends to accelerate the movement of the awning beyond the desired unrolling speed, each time the driven motor and reduction gear unit located at the upper portion of the roof of the verandah is caused to start again by the awning tension effect. As a consequence, the flexible elements constituting the extension of the free end of the awning are rolled up without being tensioned on their winding shaft. If these flexible elements consist of flat straps housed in separate winding drums they tend to be pulled out from these winding drums and thus fail to operate properly during the next awning operation in the opposite direction when rolling up the awning.

SUMMARY OF THE INVENTION

The driving device according to the present invention for awnings or like blinds is characterized by the fact that it comprises for each winding shaft a retarding device cooperating with a unidirectional driving device, these two devices being disposed between on the one hand a rotary member forming a part of the kinematic assembly connecting each rotary driving means to the corresponding winding shaft, and on the other hand a fixed support located in the vicinity of the rotary member. A rotary element common to both devices and coaxial to said rotary member supports one section of each one of said devices, is adapted to cooperate with another part of each one of them, said sections being rigid the one with the rotary member and the other with the fixed support. Each unidirectional driving device is so oriented as to provide the angular coupling between the two sections in a single direction, only when the corresponding winding shaft is rotatably driven via the awning and the flexible straps, through the means for rotatably driving the other winding shaft.

According to a first form of embodiment of the present invention the two sections of the unidirectional driving device are disposed on the movable rotary element and on the rotary element, respectively. According to another possible form of embodiment, the two sections of the unidirectional driving device are disposed on the fixed element and on the movable rotary element, respectively.

The retarder may advantageously consist of an eddy current retarder. In the case of the first form of embodiment mentioned hereinabove, this retarder comprises a copper ring rigid with the outer periphery of the movable rotary element, and fixed permanent magnets, rigid with the fixed element, separated by a narrow gap from the inner copper ring. In the second form of embodiment contemplated hereinabove, the retarder comprises a copper ring rigid with the outer periphery of the rotary element, and permanent magnets rigid with the movable rotary element and separated by a narrow gap from the copper ring.

The present invention is directed to provide an improve driving device capable of maintaining an awning under a constant tension with a reduced sag, for instance of the order of 0.2 to 0.3 meters, even if the awning is relatively long, for example 6 to 8 meters, without resorting to additional or intermediate transverse support means, while preserving the maximum power available from the driving power unit under both awning unrolling and rolling conditions, so as to improve the reliability of the complete driving system.

THE DRAWINGS

DESCRIPTION OF THE PREFERRED EMBODIMENTS

Figure 1:
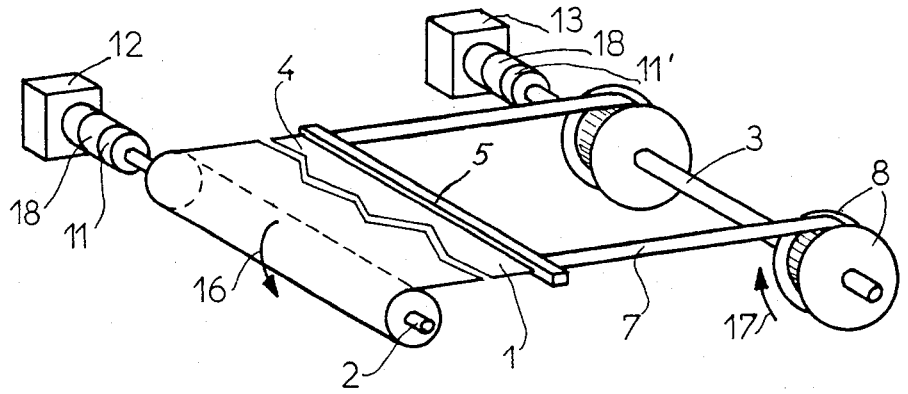
FIG. 1 illustrates in diagrammatic perspective view a first form of embodiment of the invention.

As illustrated in FIG. 1, the driving device comprises a protection awning 1 consisting of a relatively long web. The first end of this awning 1 is anchored to a first winding shaft 2 and its other or free end 4 is connected by means of a pair of flexible straps or belts 7 to the second winding shaft 3. This free end 4 is preferably stiffened by means of a transverse rigid rod 3. The flexible straps 7 are guided during the winding thereof by a pair of lateral flanges 8 rigid with the winding shaft 3.

Each winding shaft 2,3 is coupled angularly to rotary driving means consisting in this example of an electric motor, 12,13 by means of a reversible reduction gear 11,11', respectively. The first motor 12 is adapted to rotate in one direction 16 for winding the awning 1 around the corresponding shaft 2, while unwinding the flexible straps 7 from the other shaft 3. The other motor 13 is adapted to rotate in a direction 17 permitting the winding of the flexible straps 7 on their winding shaft 3 while unrolling simultaneously the awning 1 from its winding shaft 2.

Figure 2:
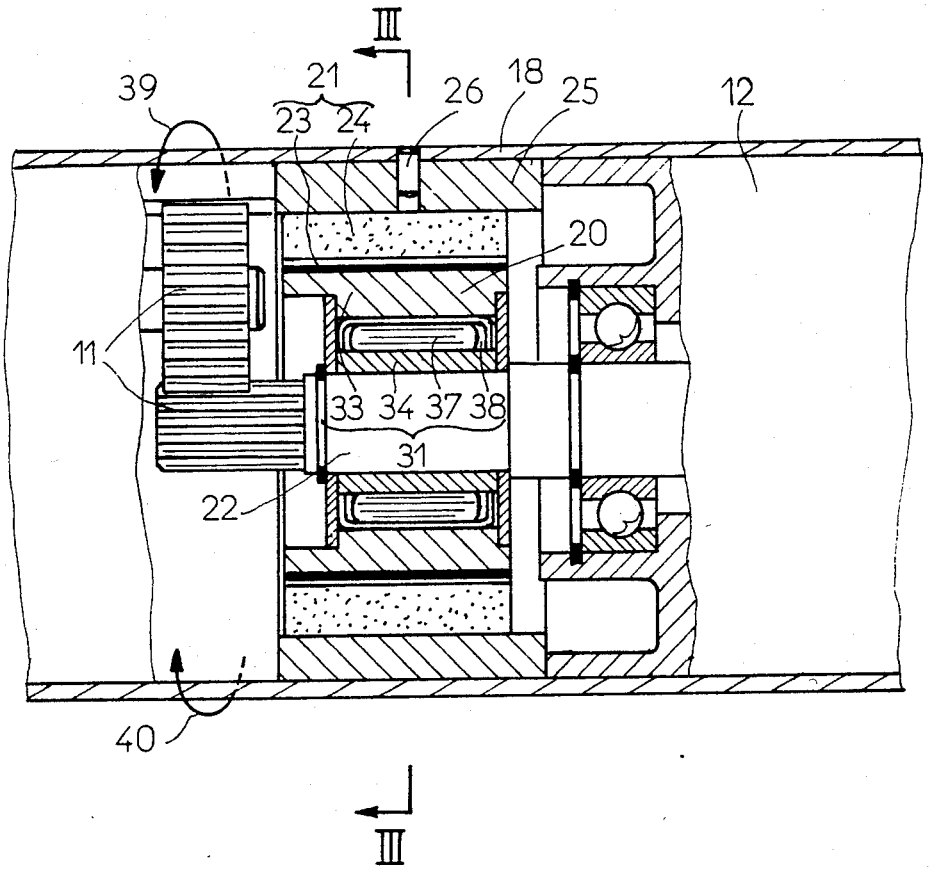
FIG. 2 is a section taken along the line II—II of FIG. 3, showing one portion of the first form of embodiment.
Figure 3:
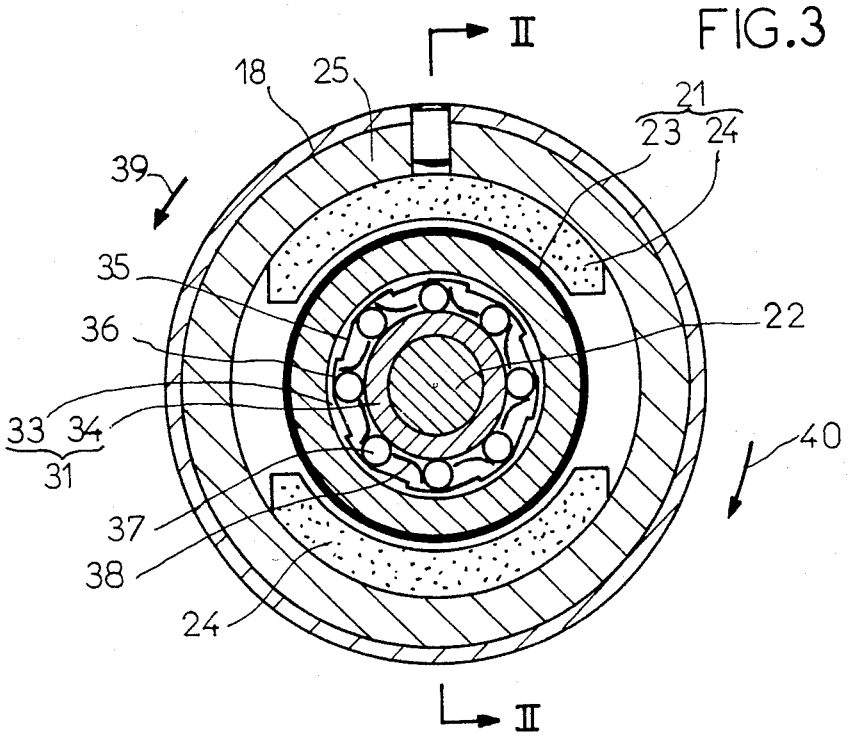
FIG. 3 is a section taken along the line III—III of FIG. 2, showing one portion of the first form of embodiment.

As illustrated notably in FIGS. 2 and 3, an intermediate portion 18 of the case of each motor and reduction gear unit, disposed for instance between the motor proper 12,13 and the relevant reduction gear 11,11' encloses a retarder 21 cooperating with a unidirectional driving device 31. These two devices 21 and 31 are disposed between on the one hand the output shaft 22 of each motor 12,13 and on the other hand a fixed support located in close vicinity of each shaft 22 and consisting of said portion 18 of the fixed case.

In this exemplary form of embodiment, each retarder 21 is of the eddy current type comprising a first portion 23 consisting of a cylindrical copper ring and a second portion 24 comprised of fixed permanent magnets. The copper ring 23 surrounds and is rigid with the outer periphery of a movable rotary element 20. This movable rotary element 20 is common to both devices and disposed coaxially around the output shaft 22. The fixed permanent magnets are cemented for example to the inner cylindrical surface of a metal ring 25 rigid in turn with the wall 18 of case 18 and prevented from rotating in relation thereto by a radial pin 26. The arrangement is such that only a reduced gap is left between the fixed magnets 24 and the copper ring 23.

Each unidirectional driving device comprises two main sections 33 and 34. The first section 33 forms part of the movable rotary element 20 common to both devices 21 and 31, and the second section 34 consists of a cylindrical socket rigid with and surrounding the output shaft 22. The first section 33 comprises on its inner surface a series of ramps 35 (FIG. 3) each separated from the next ramp by a recess 36 in which a bearing needle 37 is housed. A spring steel blade 38 housed in each recess 36 adjacent each needle 37 constantly urges this needle 37 against the corresponding ramp 35 and the outer cylindrical surface of socket 34. When shaft 22 and socket 34 are rotatably driven in the direction of the arrow 39 (FIG. 3), the movable rotary element 20 is caused to rotate in the same direction as a consequence of the wedging of needles 37 between the corresponding ramps 35 and the outer cylindrical surface of socket 34. When shaft 22 and socket 34 are driven in the reverse direction 40 (i.e. opposite 39), the rotary element 20 is not driven. Each unidirectional driving device is so oriented that it is capable of constituting an angular coupling between its two sections 33 and 34 but only when the relevant winding shaft 2,3 is rotatably driven through the awning 1 and its flexible extensions or straps 7 from the rotary driving means 13,12 of the other winding shaft 3,2.

In this example, both winding shafts 2 and 3 are disposed horizontally in a common horizontal plane and spaced several meters apart.

OPERATION

Assuming that the awning 1 is initially fully rolled on its winding shaft 2, with the flexible straps 7 unrolled simultaneously from their winding shaft 3.

To unroll the awning 1, it is only necessary to energize the motor 13 provided for rotatably driving in the direction of the arrow 17 (FIG. 1) the winding shaft 3 of flexible straps 7. The output shaft 22 of motor 13 revolves in the direction of the arrow 40 (FIG. 3), without causing the rotation of the movable element 20 of the corresponding unidirectional driving device 31, so that the relevant retarder 21 remains inoperative and does not interfere with the rotation of driving motor 13. At the same time, the awning 1 is pulled through the flexible straps 7, and the corresponding winding shaft 2 (of which the motor 12 is not energized) is caused to rotate in the direction opposite to 16 (FIG. 1). Since motors 12 and 13 are oriented so that their respective angularly coupled driving directions are opposed, the corresponding output shaft 22 of motor 12 is caused to rotate in the direction illustrated by the arrow 39 (FIG. 3). This shaft 22 in this case drives the movable element 20 and the retarder 21 associated therewith, thus providing the desired result. In other words, the magnetic field created by the permanent magnets 24 generates a current in the mild steel rotary member 20 surrounded by the copper ring 23. This current generates in this rotary member 20 a field tending to counteract the field from which it is originated, thus causing the rotary movable element 20 to slow down as well, consequently, as the corresponding driven shaft 22. Thus, the awning 1 is held stretched throughout its unrolling phase, as illustrated in FIG. 1.

For winding up the awning 1 again, it is necessary to energize the motor 12 provided for driving the winding shaft 2 in the direction of the arrow 16 (FIG. 1), this shaft becoming in turn the driving shaft without inasmuch causing the retarder 21 to play the slightest role, due to lack of angular coupling in this direction. Keeping in mind the opposite orientation of motors 12 and 13, the shaft 22 rotates in this instance in the direction illustrated by the arrow 40 (FIG. 3). Simultaneously, the driven winding shaft 3 is caused to rotate in the direction opposite to 17 (FIG. 1) by the flexible straps 7 as the latter are unwound, the corresponding output shaft 22 being caused to rotate in the direction of the arrow 39 (FIG. 3). This shaft 22 drives the corresponding rotary movable element 20 in the same direction, and it is the relevant retarder 21 within motor 13 which becomes operative and keeps the flexible straps 7 and the awning 1 taut throughout the unwinding of said straps.

In a modified form of embodiment of the invention the unidirectional driving device 31 and the retarder 21 may be inverted. Thus, the first section 33 of the unidirectional driving device 31 would be rigid with the inner surface of the fixed ring 25, and the second section 34 would be rigid with the outer surface of the movable rotary element 20. Regarding the retarder 21, its first section 23 (the copper ring) would be rigid with the outer surface of output shaft 22, and its second section 24 (the permanent magnets) would be rigid with the inner surface of the rotary movable element 20. The operation of this modified version would be exactly identical with that of the form of embodiment described hereinabove, the retarder 21 becoming operative only when the first section 33 of the unidirectional driving device 31 prevents the rotation of the second corresponding section 34 and therefore of the rotary movable element 20.

Figure 4:
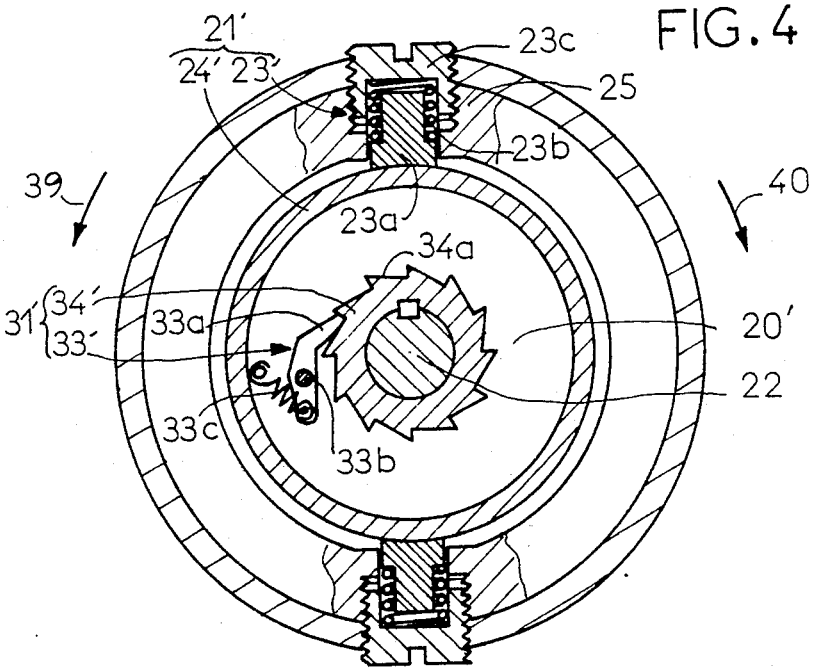
FIG. 4 is a section similar to FIG. 3 showing a second form of embodiment of the driving device.

In the second form of embodiment illustrated in FIG. 4 each unidirectional driving device 31' comprises a first section 33' consisting of a pawl **33*a* fulcrumed on a pin 33*b* supported in turn by the side face of a movable element 20' pivoting about the corresponding output shaft 22. A spring 33*c* constantly urges the pawl 33*a* for engagement with inclined ratchet teeth 34*a* formed on the second section 34' of device 31'. This second section 34' is coupled to shaft 22** by means of a key.

Each retarder 21' comprises a first section 23' supported by the corresponding fixed metal ring 25 and a second section 24' rigid with the rotary movable element 20'. The first section 23' consists of a pair of preferably diametrally opposed friction shoes **23*a* adapted to slide radially and responsive to coil springs 23*b* urging said friction shoes toward the second section 24' consisting of a cylindrical friction drum. Radially adjustable screws 23*c* each provided with a blind cavity receiving the corresponding spring 23*b* engage diametrally opposed radial tapped holes so that the pressure exerted by the friction shoe 23*a* on the cylindrical friction drum 24'** can be adjusted as required.

The teeth **34*a* are inclined in order to provided an angular coupling with the pawl 33*a* only when the output shaft 22 is rotatably driven in the direction of the arrow 39 (FIG. 4) not by the relevant motor (for example motor 12), which is denergized, but by the relevant winding shaft 2 driven in turn for rotation in the direction opposite to that of the arrow 16 (FIG. 1) by the other motor 13, via the flexible straps 7 and the awning 1. Thus, the corresponding rotary movable element 20' is caused to rotate, the retarder 21' becomes operative and causes the winding shaft 2 to slow down and consequently the unrolling of the awning 1. The retarder 21', however, becomes useless when the shaft 22 and the inclined teeth 34*a* are driven for rotation in the direction of the arrow 40 for example by the motor 12, and the corresponding rotary movable element 20', in this case, is not driven for rotation in the same direction 40 (FIG. 4**).

All the other component elements of the device are the same as those of the first form of embodiment (FIGS. 1–3) and the assembly operates like one of the first form of embodiment.

In all the forms of embodiment described hereinabove with reference to the accompanying drawings it will be seen that for each motor, when it operates as the driving motor, the maximum possible power output is available, since only the driven winding shaft is braked by the corresponding retarder.

Without further analysis, the foregoing will so fully reveal the gist of the present invention that others can by applying current knowledge readily adapt it for the various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed is:

1. A device for driving a protection awning adapted to be at least partially spread horizontally, having one end attached to a first winding shaft and the other free end connected through at least one flexible strap to a second winding shaft, each winding shaft being coupled angularly to rotary driving means, one of said rotary driving means being adapted to rotate in one direction permitting the winding up of the awning on said first winding shaft while unwinding said flexible strap from the other winding shaft, the other rotary driving means being adapted to rotate in one direction permitting of winding up said flexible strap on said second winding shaft while unrolling simultaneously said awning from the other winding shaft, wherein there is provided for each winding shaft eddy-current type rotation retarding means cooperating with a single unidirectional driving device, each said unidirectional devices being disposed between on the one hand a rotary nember forming part of a kinematic assembly connecting each rotary driving means to the corresponding winding shaft, and on the other hand a fixed support located in close vicinity of said rotary member, a rotary movable element common to both devices, coaxial to said rotary member, supporting one section of each one of said two devices and adapted to cooperate with another section of each device which is rigid the one with said rotary member and the other with said fixed support, each unidirectional driving device being so oriented as to provide the angular coupling between its two sections only when the corresponding winding shaft is being driven for rotation, through said awning and said flexible strap, from said means for rotatably driving said other winding shaft.

2. The driving device of claim 1, wherein the two sections of each said unidirectional driving device are disposed on said rotary movable element and said rotary member, respectively, said eddy-current type rotation retarding means comprising a copper ring rigid with the outer peripheral surface of said movable rotary element, and fixed permanent magnets rigid with said fixed element and disposed around said copper ring with a minimum gap between said magnets and said ring.

3. A device for driving a protection awning, said awning to be spread at least partially horizontally, comprising:

a first winding shaft connected to one end of said awning, and a second winding shaft connected to an end of at least one flexible strap, the other end of said strap being further connected to said free end of said awning, said first winding shaft being coupled angularly to rotary driving means for rotating said shaft in one direction permitting the winding up of said awning on said first winding shaft while unwinding said flexible strap from said second winding shaft, said second winding shaft being coupled angularly to rotary driving means for rotating said shaft in one direction permitting the winding up of said flexible strap on said second winding shaft while unrolling simultaneously said awning from said first winding shaft, and said first and second shafts each having eddy-current type rotation retarding means connected thereto for preventing rapid angular acceleration of said shafts during winding and unwinding of said awning.

4. A protection awning driving device according to claim 3 wherein each rotary driving means for rotating its shaft in one direction further comprises:

a cylindrical socket rigid with and surrounding the winding shaft, and a movable rotary element having on its inner surface a series of ramps, separated from one another by recesses for housing bearing needles and spring blades, said blades urging said needles against said ramps and the outer cylindrical surface of said cylindrical socket, so that when each said shaft is rotatably driven through the awning or straps from the rotary driving means of the other winding shaft, said movable rotary element is caused to rotate in the same direction as its associated shaft, and when each said shaft is driven by its own associated rotary driving means, said movable rotary element does not rotate.

5. A protection awning driving device according to claim 4, wherein said eddy-current type rotation retarding means further comprises:

a copper ring surrounding and fixed to the outer periphery of said movable rotary element, and fixed permanent magnets fixed to the inner cylindrical surface of said rotary driving means with only a slight gap separating said ring and said magnets, so that a current is generated by the magnetic field between said ring and said magnets when said movable rotary element is driven by its associated winding shaft, said current tending to oppose the rotation of said winding shaft.

* * * * *